US005553792A

United States Patent [19]

Romer et al.

[11] Patent Number: 5,553,792

[45] Date of Patent: Sep. 10, 1996

[54] VARIABLE ANALYTICAL SAMPLING MILL AND METHOD

[75] Inventors: Thomas R. Romer; Kraig K. Bond, both of Washington, Mo.

[73] Assignee: Romer Labs, Inc., Union, Mo.

[21] Appl. No.: 459,412

[22] Filed: Jun. 2, 1995

[51] Int. Cl.[6] ..... B02C 7/06; B02C 7/14

[52] U.S. Cl. ..... 241/29; 241/186.3; 241/247; 241/261.2

[58] Field of Search ..... 241/29, 247, 186.3, 241/260.1, 261.2

[56] References Cited

U.S. PATENT DOCUMENTS

| | | | |
|---|---|---|---|
| 3,376,971 | 4/1968 | Greer et al. | 241/186.3 X |
| 4,027,824 | 6/1977 | Fuller | 241/247 X |
| 4,201,349 | 5/1980 | Walsh | 241/247 |
| 4,253,613 | 3/1981 | Reinhall | 241/16 |
| 4,679,737 | 7/1987 | Romer | 241/29 |

*Primary Examiner*—John M. Husar
*Attorney, Agent, or Firm*—Robbins & Robbins

[57] ABSTRACT

A sampling mill for grinding discrete materials to obtain a representative sample is provided by this invention. The mill is particularly useful for grinding various foodstuffs such as corn, peanuts, animal foods and the like. The material to be sampled is fed to a rotary worm gear of substantial length connected to a burr plate to feed the material between a second plate. By varying the worm gear with comminuting means, the placement of burrs on the burr plate and the distance between the burr plates, the size of the ground sample can be varied and different types of foodstuffs can be ground and sampled as compared to a grinder with limited adjustability. The ground sample is distributed to a main discharge chute and a sampling chute with an adjustable valve to provide a selected small percentage of the total ground foodstuff.

19 Claims, 5 Drawing Sheets

VARIABLE ANALYTICAL SAMPLING MILL AND METHOD

BACKGROUND OF THE INVENTION

This invention updates improvements on Romer U.S.. Pat. No. 4,679,737 for Grinding Sub-Sampling Mill and Method for preparations of Test Sample. This former mill applies to grains, soybeans, and pelleted feeds but does not apply to peanuts, tree nuts, silage, haylage or cottonseed. As mycotoxins as well as herbicides and pesticides can be found in these latter commodities in addition to the former, it is important to the food and agricultural industries that an improved grinding/subsampling mill be developed. No mill has been available that can even grind all of the above commodities including grains, soybeans, and pelleted feeds, much less simultaneously subsample the ground material. The previous mill also does not apply to large particles. Some pelleted feeds, including some dog foods, horse and cattle feeds, as well as pelleted corn gluten feed have pellets that are too large to fit into the patented Romer mill. Also commodities such as in-shell walnuts are too large for the patented Romer Mill Another new feature that has been found desirable involves the grind lever adjustments. The grind lever adjustment determines the distance between the stationary and rotating disks or burrs plates and thus the particle size. The grind lever on the Romer mill of U.S.. Pat. No. 4,679,737 can only be rotated about ½ a full revolution without the extra time and work of disengaging the grind lever. Also, the grind lever is located under the burr plates housing. This makes it somewhat awkward to rotate the grind lever but, more important, makes it necessary to place the grinder unit on its back in order to thoroughly clean the burrs and feed worm.

In the mill of this invention, the burr plates rotate vertically rather than horizontally and the grind lever is at the front of the unit. Also, the grind lever can be turned one full turn during which the particle size of ground corn, for example, can be changed from 1.0 mm to about 250 mm in diameter. This adjustment is necessary in order to set the proper grind size for different commodities as well to adjust for moisture and fat levels in each commodity. An added benefit of this ability to rapidly and drastically change the particle size is that a user who is testing corn for aflatoxin can easily "crack" the corn into four or five particles per kernel, perform the "blacklight test" which looks for bluish green fluorescent (BGF) dots on the corn particles. Such "glowers" are observable and characteristic of aflatoxin contaminated corn and provide a rapid simple "screening" test for aflatoxin contamination. If the BGF test is positive, the "cracked" corn can be reground to a fine particle size (by a simple adjustment with the grind lever) and a chemical test for aflatoxin can be performed.

The cleaning of the burrs and feed worm is also much easier with the mill of this invention. The cover plate directly faces the operator and after removing wing-nuts, the rotating burrs-feed worm can be removed as one piece. This whole cleaning process requires about one minute compared to the five minutes required for the patented mill.

In order to grind high fat items such as peanuts and tree nuts (almonds, walnuts, pistachios, brazil nuts, etc . . . ) it was necessary to modify the stationary burr-feed worm unit by putting a groove into the feed worm threads, an extra opening in the stationary burr plate, and removing some of the burrs on the rotating burr plate. High fat items can be pushed by the feed worm (which also has sharp cutting threads) with larger particles being recycled back through the opening in the top of the rotating burr plate and not ground to a fat slurry because of the removal of some of the burrs on the rotating burr plate.

The two different feed worm-burr plate units can be easily and rapidly exchanged. A different rotary burr plate-feed worm unit without the groove in the feed worm, opening in the top of the burr plate or removal of some burrs is used for corn and other low fat materials may be used as desired.

The new mill also applies to silage, hay, and cottonseed. Because the long feed worm at the base of the hopper constantly forces these materials into the burr plates whereas with the Patented Romer Mill, gravity is the force used to push the commodity into the small feed worm.

The "Dickens" mill of U.S. Pat. No. 3,830,436 is the only other mill found to be available for both grinding and subsampling agricultural commodities. However, the Dickens mill only applies to peanuts and does not apply to corn, silage, haylage or cottonseed and requires the use of a screen and concentric collection sector and does not employ the features of the instant invention. Also, I am not aware of the Dickens mill having been applied to tree nuts.

Because the burr sets on the newly invented mill are vertical, the 3 chute splitting system used with the patented mill does not apply (gravity would force most of the material to exit out of the lowest chute.) A new splitting device was designed that fulfills the same function, that is, from 10% to 80% of the ground material can be split from the stream of ground commodity in such a way that a representative subsample can be obtained.

SUMMARY OF THE INVENTION

By means of this invention there has been provided an analytical subsampling mill in which the grinding features may be varied to fit the requirements for various materials. Such materials are, while not limited thereto, particularly foodstuffs.

Such foodstuffs such as corn, wheat, peanuts, cotton seed, nuts in a hard shell and animal food vary in various physical aspects including size, hardness, fat content, and other physical characteristics. Through the grinding mill of this invention, various mechanical grinding features as well as the fineness of the ground material and percentage of test sample may be readily varied.

The apparatus is generally composed of a hopper for charging the material to be ground to a worm gear. The worm gear charges the material between burr plates where it is ground. By fixing a burr plate to the worm gear and providing a stationary burr plate through which the worm gear is fitted, construction is simplified and replacement of the worm gear and connected burr plate as a set for different specifications is facilitated.

The test sample is provided by a single opening in the housing by the side of the periphery of the burr plates where the ground material is expelled by centrifugal force. Divergent main discharge and test sample discharge chutes have a common throat at this opening which facilitates the distribution and sampling of the ground material. Slide valves in the main discharge chute and test sample chute provide for complete closing of the chute for further grinding and opening to select the desired percentage charge to the test sample chute.

The grinder mill of this invention provides uniform mixing and grinding that can be readily accomplished in the field under rugged conditions of use. The various provisions for adjustment make it possible to provide properly representative test sampling of different materials particularly foodstuffs, not otherwise available The above features are objects of this invention. Further objects will appear in the detailed description which follows and will be otherwise apparent to those skilled in the art. For the purpose of illustration or a proferred embodiment is illustrated for example in the drawing below. In the drawings:

DESCRIPTION OF THE INVENTION

Figure 1:
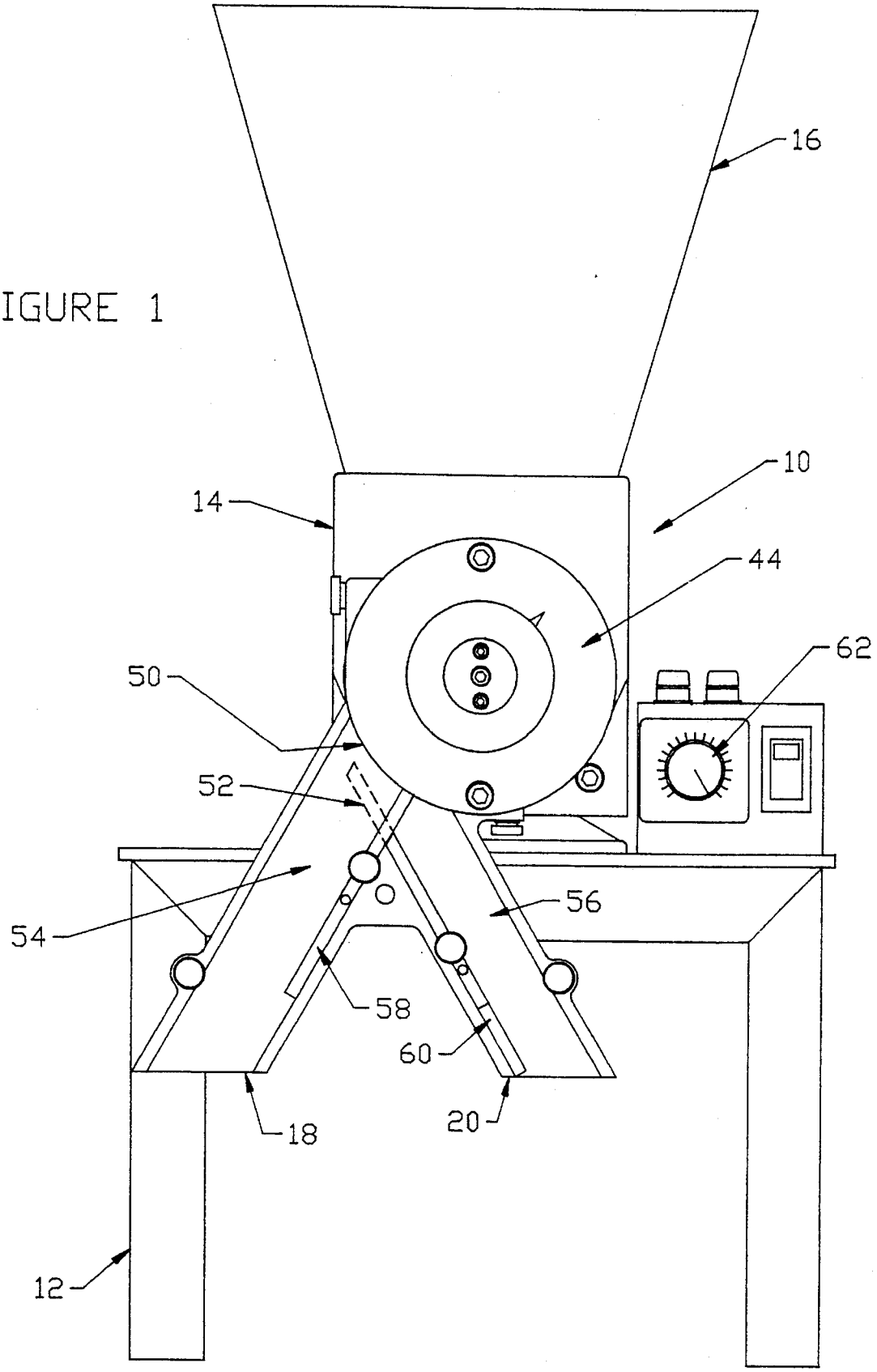
FIG. 1 is a view in front elevation of the mill.
Figure 2:
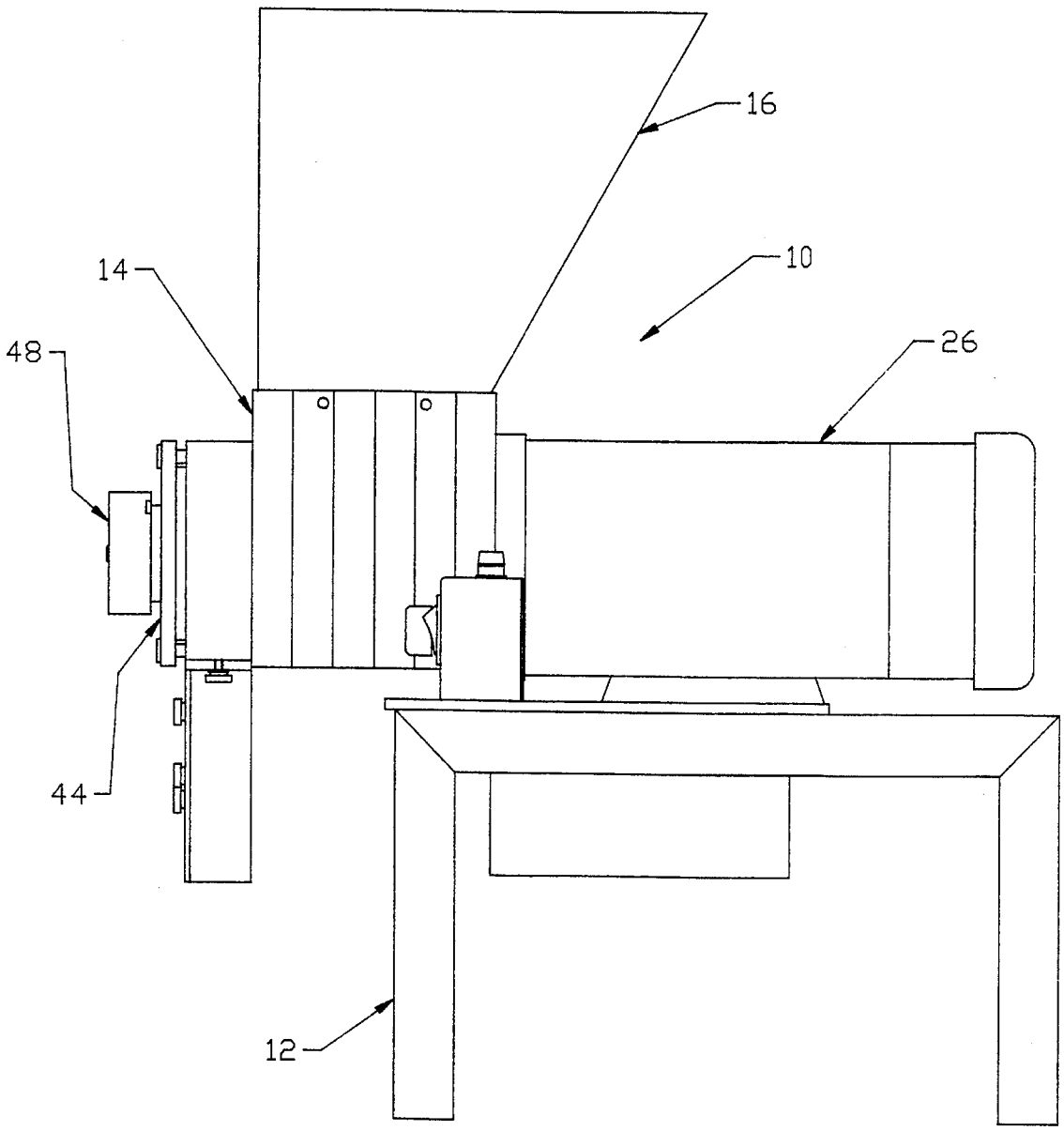
FIG. 2 is a view in side elevation of the mill taken from the fight side of FIG. 1.
Figure 3:
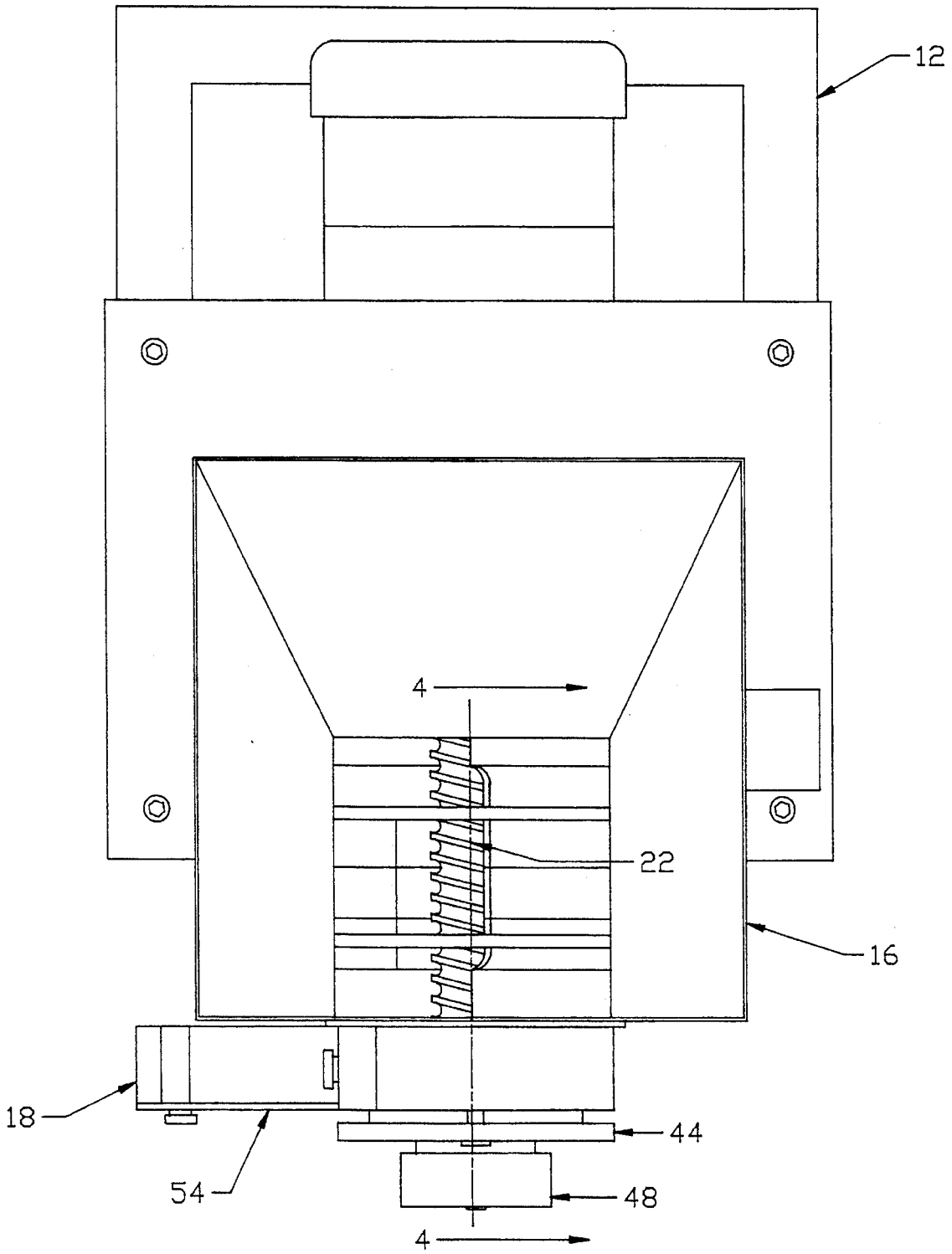
FIG. 3 is a top plan view of the mill.

The mill of this invention is generally indicated by the reference numeral 10 in FIGS. 1,2 and 3. It is supported on a table stand 12 and comprises a mill housing 14, a feed hopper 16, a main discharge chute outlet 18 and a test sample outlet 20

Figure 4:
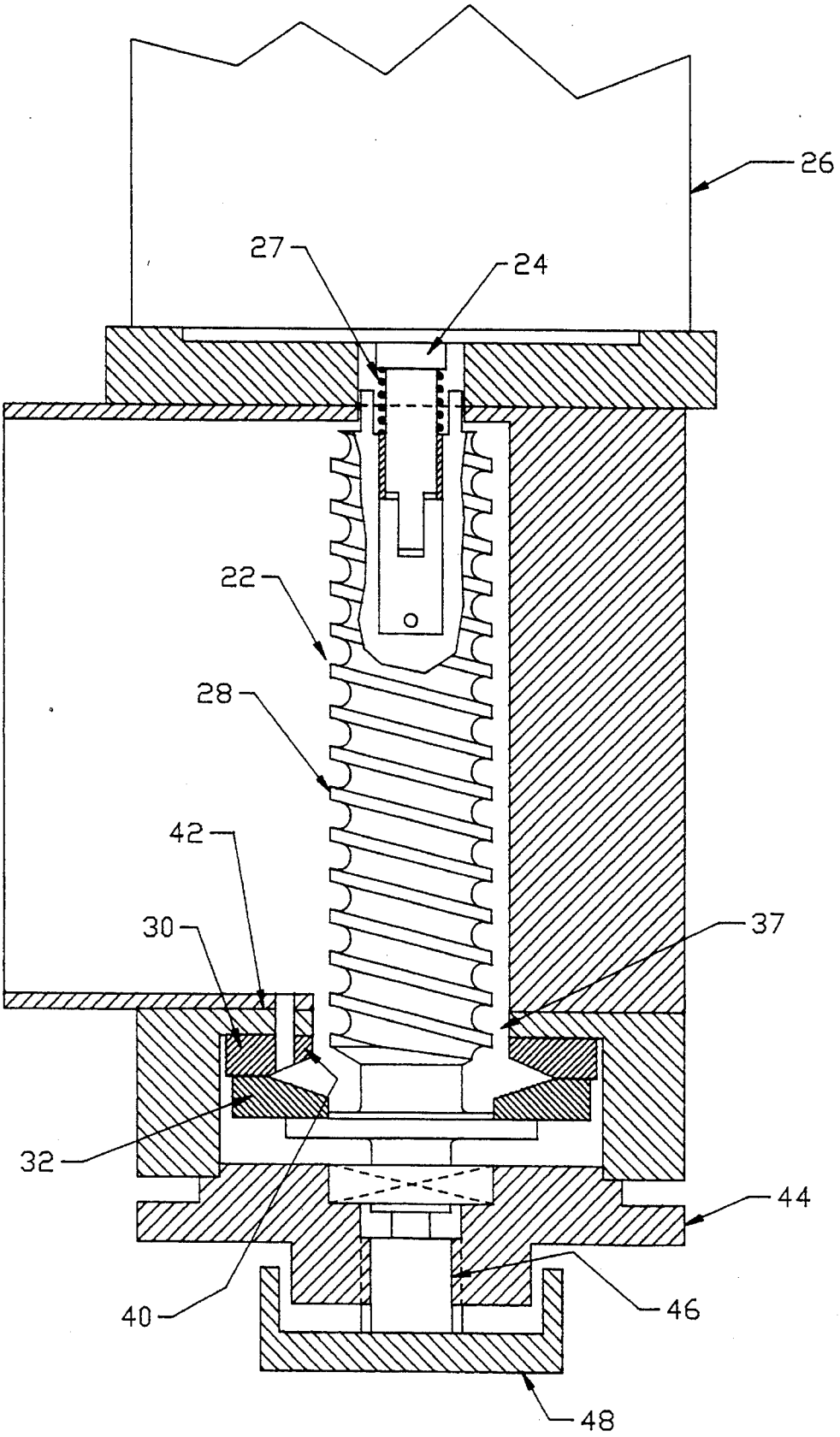
FIG. 4 is an enlarged view in section taken on line 4—4 of FIG. 3.
Figure 5:
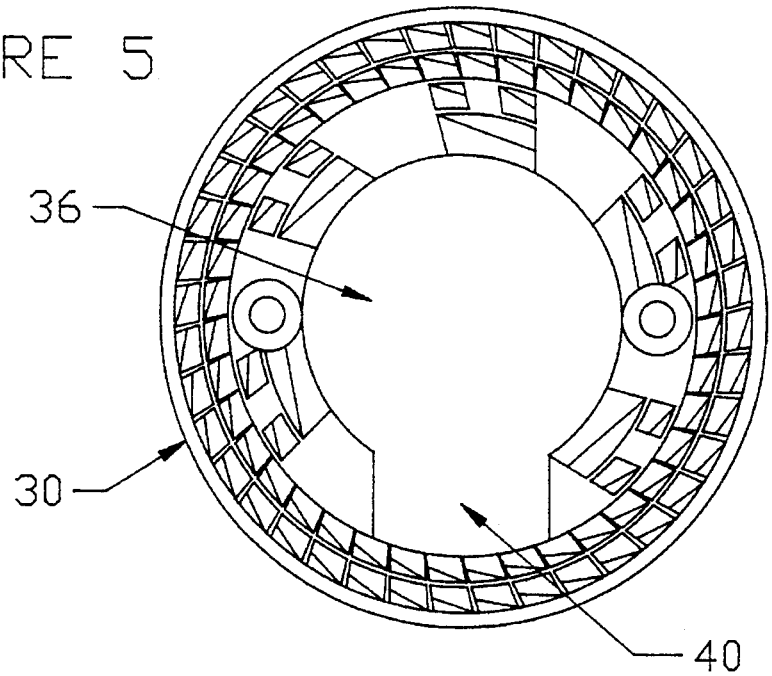
FIG. 5 is a plan view of the stationary burr plate.

As best shown in FIGS. 3 and 4 the hopper 16 opens into an elongated worm gear 22 powered by a drive shaft 24 and a conventional motor 26. The drive shaft is spring loaded by spring 27 to allow for relative axial movement. The worm gear has splines 28 which advance the material to be ground to a pair of burr plates 30 and 32. Both burr plates are in the form of disks provided with burr elements or teeth on opposing faces. The splines of the worm gear may be continuous or provided with axial grooves 34 as shown in the cross-section view of FIG. 6. The axial grooves act as communicating elements which improve the grinding treatment of foodstuffs having a relatively high fat content such as peanuts, cotton seed and some animal foods.

As best shown in FIG. 4, burr plate 30 is stationary and is fixed to the housing. It has a central opening 36 which receives the worm gear 22 and provides a passage 37 through which the material is forced by the worm gear between the burr plates. An opening 40 in the burr plate 30 communicates with a passage 42 in the housing to provide for recycling of some of the ground material for additional treatment.

The burr plate 32 is fixed to the drive shaft and rotates with it at the selected speed to provide for forcing the material from the bottom of the hopper between the burr plates for grinding. As will be further described, the burr plate 32 and the worm gear may be removed as a unit for cleaning.

A retaining plate 44 acts as a funnel for an end 46 of the worm gear. A rotary dial 48 is mounted on the face plate and by threaded engagement with the retaining plate 44 is used to move the worm gear and connected face plate—to adjust the opening between the two burr plates rough and fine as desired.

The material after being ground between the burr plates is discharged to an outlet opening 50 in the homing to the throat 52 of divergent v-shaped chutes 54 & 56. Chute.54 is a main discharge chute while chute 56 is an adjustable test sample chute. Chute 54 is provided with a side valve 58 moveable to open or close the opening 50.

In order to provide for sampling, a portion of the completely ground material and discharge into chute 56 for recovery, a slide valve 60 is provided. This valve is moveable across chute 54 and may be adjusted to divert, as an example 10% to 80% of the ground material to the chute 56 for sampling.

METHOD OF USE

The mill of this invention is simply employed for a variety of materials, particularly foodstuffs of one type or another. Such foodstuffs are desirably test samples for mycotoxins such as aflatoxin and require different grinding preparations for different foodstuffs and different tests.

In general, the mill may be adjusted to fit the needs of different foodstuffs as to size of the ground material, physical requirements of the foodstuffs such as corn, wheat, cotton seed, peanuts, nuts in hard shells, dog food and other animal foods.

In use the foodstuff is fed into the hopper 16 where it is charged to the worm gear 22 by gravity and forced through the opening between the stationary plate and worm gear between the burr plates where it is ground. The speed of rotation of the worm gear 22 and burr plate 32 is installed by motor speed dial 62. For some foodstuffs such as peanuts and cottonseed and some animal foods having a higher fat content than corn, as an example, recycling of the ground material through the passage 42 back to the worm gear provides additional treatment to aid in proper grinding. For such materials large particles may be formed in which such recycling is beneficial.

Figure 6:
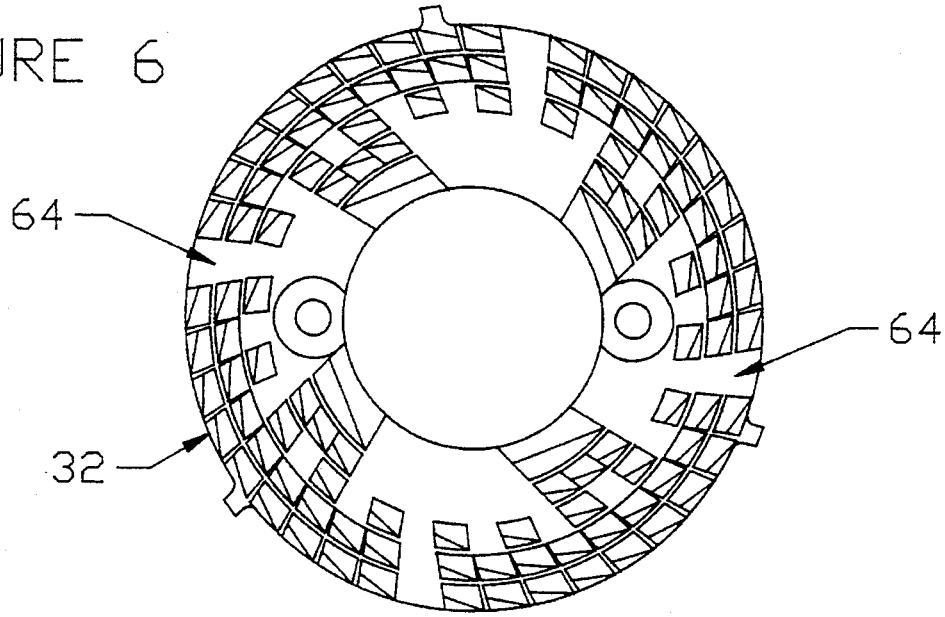
FIG. 6 is a plan view of a rotary burr plate.
Figure 7:
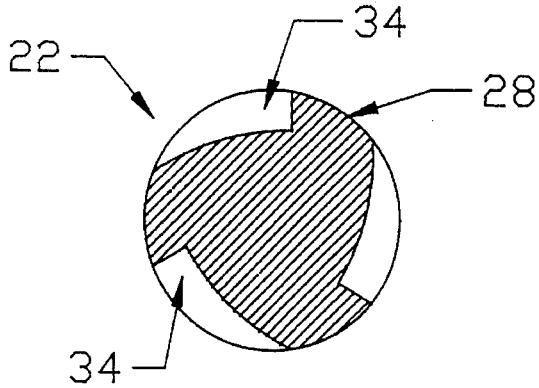
FIG. 7 is a cross-section of a modified worm gear.

When such high fat feedstuffs are treated, the worm gear having a continuous spline or thread may desirably be replaced by one having axial grooves 34 as shown in FIG. 7. This aids in the treatment of such material. Also the burr plate 32 may be replaced with a plate as shown in FIG. 6 having a reduced member of burr elements such as provided by the open space 64. By replacing the worm gear and burr plate 32 as a unit, the treatment is simplified for processing different foodstuffs.

The foodstuff being ground may be varied to the extent of the fineness of the grind by adjusting the dial 48 mounted on the retaining plate 44. By rotation to the selected degree the worm gear and burr plate 32 may be moved axially to vary the spacing between the plate to vary the size of the grind.

After the material has been ground, the material may be divided according to the requirements of the operator by adjusting the test sample chute valve 60. This may as an example, be used to divert a 10% sample to test sample chute 56 and 90% to main chute 54. Various changes and modifications may be made in this invention as will be apparent to those skilled in the art. Such changes and modifications are within the scope of this invention as defined by the claims appended hereto.

What is claimed is:

1. Apparatus for uniformly grinding a discrete solid material and obtaining a small representative sample thereof, said apparatus comprising means for delivering particles of said material to a worm gear, said worm gear being fixed to a rotatable burr member, a stationary burr member closely spaced to said rotary burr member, means for rotating said worm gear and rotatable burr member as a unit to charge said particles between said burr members for grinding said particles and propelling by centrifugal force to an opening communicating with a main discharge outlet and a test sample outlet and means for restricting said opening to provide a small percentage of said ground particles for test analysis to said test sample outlet and a major portion to said main discharge outlet.

2. The apparatus of claim 1 in which said main discharge outlet and test sample outlet comprise separate main discharge and separate test sample passages converging to said opening at a periphery of said burr member.

3. The apparatus of claim 2 in which the test sample passage comprises an adjustable valve for providing a selected percentage of total ground particles discharged from the apparatus.

4. The apparatus of claim 2 in which both the main discharge outlet and test sample outlet are provided with means for completely closing the outlets.

5. The apparatus of claim 1 in which the apparatus is provided with means for varying the spacing between said burr members to vary the particle size of the ground material discharged from the apparatus.

6. The apparatus of claim 1 in which the worm gear has helical splines provided with means for comminuting the material.

7. The apparatus of claim 6 in which said means for comminuting the material comprises axial grooves along outside edges of said splines.

8. The apparatus of claim 1 in which said rotary burr member and said worm gear are removable received within said apparatus means are provided on a retaining plate for rotating said plate to move said worm gear axially to vary the spacing of the burr members, said retaining plate being removable and said rotary burr member and said worm gear are removable from the apparatus as a unit for inspection and cleaning upon removal of said retaining plate.

9. The apparatus of claim 8 in which said apparatus comprises a housing, hopper means supported by said housing for discharge to said worm gear, said worm gear being supported within a tubular passage in said housing along a horizontal axis and said rotable burr member and said stationary burr member comprising generally plate-like elements having a horizontal axis.

10. The apparatus of claim 1 in which said apparatus comprises a housing, hopper means supported by said housing for discharge to said worm gear, said worm gear being supported within a tubular passage in said housing along a horizontal axis and said rotable burr member and said stationary burr member comprising generally plate-like elements having a horizontal axis, means for recycling at least a portion of said material comprising an opening in one of said burr members communicating with a recycle passage leading to said worm gear backstream of said burr member.

11. The apparatus of claim 1 in which said apparatus comprises a housing, hopper means for discharge of said material to a worm gear, said worm gear being fixed to said rotary burr member at a forward portion of said worm gear and said stationary burr member being connected to said housing and having an opening receiving said worm gear therethrough.

12. A method for uniformly grinding a solid foodstuff to obtain a small representative sample comprising charging discrete particles of said foodstuff to worm gear enclosed in a congruent passage, through said worm gear charging said foodstuff to a first burr member having a central opening, said first burr member being closely aligned with an opposed facing second burr member, at least one of said burr members being rotated to grind said foodstuff between said burr members, discharging said foodstuff centrifugally outward to an outlet opening dividing a first portion of said ground foodstuff from said outlet opening in a main discharge passage and a second portion from said outlet opening into a test sample passage, and restricting said second passage to provide a test sample of small percentage of the total ground foodstuff for analysis to the test sample passage and a major percentage of the foodstuff to said main discharge passage.

13. The method of claim 12 in which the foodstuff is comminuted as it is passed by the worm gear for foodstuff having a substantial fat content.

14. The method of claim 12 in which the first and second burr members are moved toward and away from one another to vary the particle size of the ground foodstuff.

15. The method of claim 12 in which the second burr member and the worm gear are connected to one another, selectively employed as a replaceable unit, the second burr member with worm gears having a helical spline for charging one type of foodstuff and a modified spline for a second type of foodstuff.

16. The method of claim 15 in which the modified spline has axially extending peripheral grooves for comminuting foodstuff comprising peanuts and cotton seed having a relatively high fat content.

17. The method of claim 12 in which at least a portion of the foodstuff is recycled from the burr member backstream to the worm gear for additional treatment.

18. The method of claim 12 in which for treatment of foodstuffs having a relatively high fat content the number of burr elements is reduced by providing open spaces in a face of the burr member provided with said burr elements.

19. Apparatus for uniformly grinding a discrete solid material and obtaining a small representative sample thereof, said apparatus comprising means for delivering particles of said material to a worm gear, said worm gear being fixed to a rotatable burr member, a stationary burr member closely spaced to said rotary burr member, means for rotating said worm gear and rotable burr member as a unit to charge said particles between said burr members for grinding said particles and propelling by centrifugal force to an opening communicating with a main discharge outlet and a test sample outlet and means for restricting said opening to provide a small percentage of said ground particles for test analysis to said test sample outlet and a major portion to said main discharge outlet, said main discharge outlet and test sample outlet comprising separate main discharge and test sample passages converging to said opening at a peripheral portion of said stationary burr member, means for controlling flow of ground particles in each of said passages comprising separate slide valves for each of said passages, each of said slide valves being moveable along an axis of one of said passages across a second of said passages.

* * * * *